US009818278B2

(12) United States Patent
Tang

(10) Patent No.: US 9,818,278 B2
(45) Date of Patent: Nov. 14, 2017

(54) INTELLIGENT HOUSEHOLD CONTROLLER

(71) Applicants: NANNING FUGUI PRECISION INDUSTRIAL CO., LTD., Nanning (CN); HON HAI PRECISION INDUSTRY CO., LTD., New Taipei (TW)

(72) Inventor: Hong-Bo Tang, Shenzhen (CN)

(73) Assignees: NANNING FUGUI PRECISION INDUSTRIAL CO., LTD., Nanning (CN); HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/165,050

(22) Filed: May 26, 2016

(65) Prior Publication Data

US 2017/0154511 A1 Jun. 1, 2017

(30) Foreign Application Priority Data

Nov. 27, 2015 (CN) ..... 2015 2 0963863 U

(51) Int. Cl.

| | |
|---|---|
| ***G08B 1/08*** | (2006.01) |
| ***G08B 19/00*** | (2006.01) |
| ***G08B 13/24*** | (2006.01) |
| ***G08B 17/11*** | (2006.01) |
| ***G08B 3/00*** | (2006.01) |
| ***G08B 5/00*** | (2006.01) |

(52) U.S. Cl.

CPC ..... *G08B 19/005* (2013.01); *G08B 3/00* (2013.01); *G08B 5/00* (2013.01); *G08B 13/2491* (2013.01); *G08B 17/11* (2013.01)

(58) Field of Classification Search

CPC combination set(s) only.
See application file for complete search history.

(56) References Cited

U.S. PATENT DOCUMENTS

| | | | | |
|---|---|---|---|---|
| 6,574,234 | B1 * | 6/2003 | Myer | H04L 12/2832 370/438 |
| 7,551,071 | B2 * | 6/2009 | Bennett, III | H04L 12/2803 340/12.54 |
| 9,412,248 | B1 * | 8/2016 | Cohn | G08B 19/005 |
| 2005/0222820 | A1 * | 10/2005 | Chung | G08B 13/19645 702/188 |
| 2005/0267605 | A1 * | 12/2005 | Lee | G05B 15/02 700/19 |
| 2010/0280635 | A1 * | 11/2010 | Cohn | G08B 29/02 700/90 |
| 2016/0351043 | A1 * | 12/2016 | Tabe | H04N 21/814 |

* cited by examiner

*Primary Examiner* — Travis Hunnings
(74) *Attorney, Agent, or Firm* — Steven Reiss

(57) ABSTRACT

An intelligent household controller includes a communication unit, a central controller, an alarm unit, and a button. The communication unit is configured to receive information collected by at least one sensor, and can forward control commands to the at least one sensor. The central controller is electrically connected to the communication unit for receiving and processing information received by the communication unit and can output processed information and control commands to the communication unit and to a terminal device in user possession. The alarm unit is electrically connected to the central controller and can output audible alarm. The button is electrically connected to the central controller for switching between modes of operation according to user's desire.

9 Claims, 1 Drawing Sheet

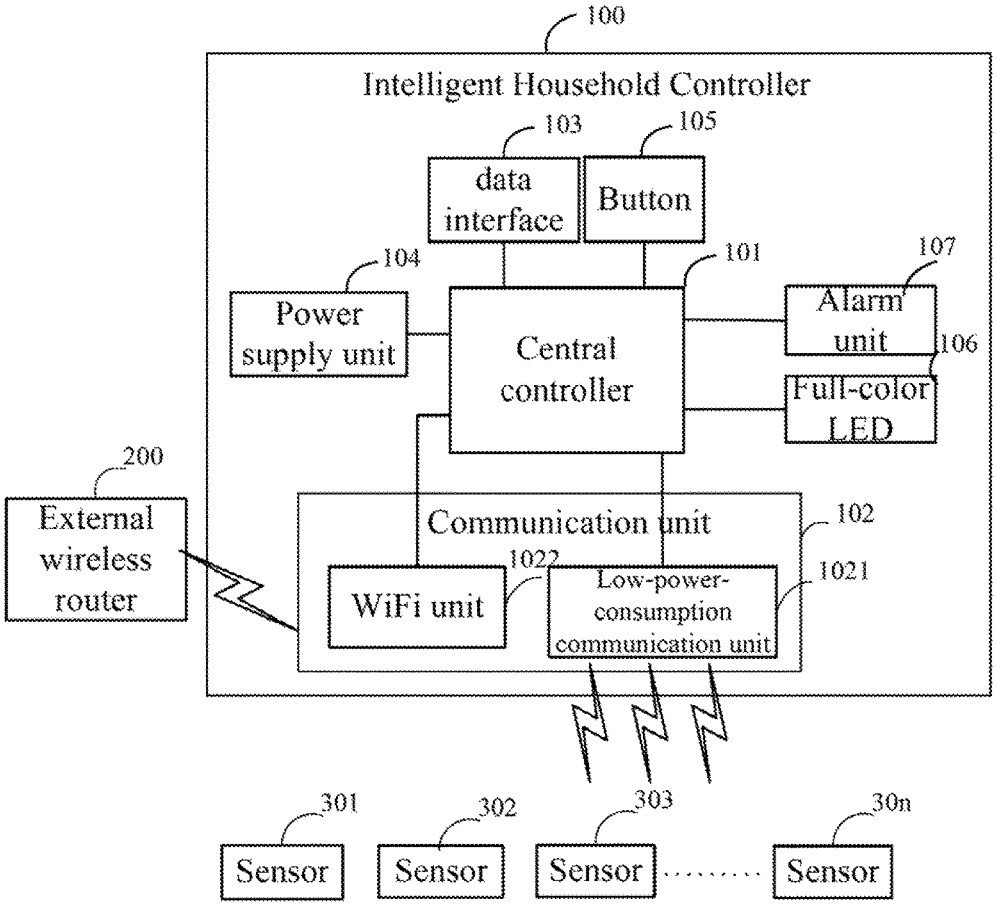
100
Intelligent Household Controller
103
105
data interface
Button
104
101
107
Power supply unit
Central controller
Alarm unit
106
Full-color LED
200
External wireless router
Communication unit
102
1022
1021
WiFi unit
Low-power-consumption communication unit
301
302
303
30n
Sensor
Sensor
Sensor
Sensor

INTELLIGENT HOUSEHOLD CONTROLLER

CROSS-REFERENCE TO RELATED APPLICATIONS

This application claims priority to Chinese Patent Application No. 201520963863.9 filed on Nov. 27, 2015, the contents of which are incorporated by reference herein.

FIELD

The subject matter herein generally relates to a domestic system controller, and particularly to an intelligent household controller.

BACKGROUND

Intelligent household controllers are popular, but most intelligent household controllers have disadvantages of large size and single function, which does not satisfy the user's requirements.

BRIEF DESCRIPTION OF THE DRAWINGS

Implementations of the present technology will now be described, by way of example only, with reference to the attached drawing.

The drawing entitled FIG. 1 is a block diagram of an embodiment of an intelligent household controller.

DETAILED DESCRIPTION

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawing is not necessarily to scale and the proportions of certain parts have been exaggerated to better illustrate details and features of the present disclosure.

The term "comprising," when utilized, means "including, but not necessarily limited to"; it specifically indicates open-ended inclusion or membership in the so-described combination, group, series, and the like.

FIG. 1 illustrates an embodiment of an intelligent household controller 100. In at least one embodiment, the intelligent household controller 100 comprises a central controller 101, a communication unit 102, a data interface 103, a power supply unit 104, a full-color LED 106, and an alarm unit 107. In the embodiment, the communication unit comprises a low power consumption communication unit 1021 and a WiFi unit 1022.

In at least one embodiment, the low power consumption communication unit 1021 is configured to receive information collected by the at least one sensor **301~30*n*. In this disclosure, the at least one sensor 301~30*n*** can be temperature sensor, humidity sensor, infrared sensor, smoke sensor, magnetism sensor, or other sensors. The at least one sensor can be a combination of one or more of the sensors or can be chosen in accordance with the user's requirement.

The low power consumption communication unit 1021 is electrically connected to the central controller 101, and is configured to send the information collected by the at least one sensor **301~30*n* to the central controller 101. In the embodiment, the low power consumption communication unit 1021 meets specification of IEEE 802.15.4, and the low power consumption communication unit 1021 can be electrically connected to the central controller 101** by a serial bus, a serial port, or other means.

The central controller 101 is electrically connected to the WiFi unit 1022, the full-color LED 106, and the alarm unit 107. The WiFi unit 1022 is matched with the external wireless router 200. The central controller 101 receives the information sent from the communication unit 102 and processes the information. The central controller is further configured to send processed information to the communication unit 102. For example, when the central controller 101 determines that the density of smoke collected by the smoke sensor exceeds a predetermined value, the central controller 101 sends the instant smoke density reading and difference between that reading and the predetermined value to the WiFi unit 1022, and a first warning signal is output. When the central controller 101 determines that the house has been burglarized according to the information collected by the magnetism sensor, the central controller 101 sends the information to the WiFi unit 1022, and a second warning signal is output.

The alarm unit 107 receives different warning signals, such as the first warning signal or the second warning signal, output by the central controller 101, and outputs audible alarm signals with different properties in accordance with the different warning signals. In at least one embodiment, the properties of the audible alarm signal can include frequency, rhythm, or volume. The full-color LED 106 receives the different warning signals output by the central controller 101 and emits different colors in accordance with the different warning signals. The alarm unit 107 combined with the full-color LED 106 can achieve dual alarm. For example, in one embodiment when the central controller 101 determines that the smoke density value collected by the smoke sensor exceeds the predetermined value, the central controller 101 outputs the first warning signal to control the alarm unit 107 to output a first audible alarm signal with 80 dBA of volume and controls the full-color LED 106 to turn red. When the central controller 101 determines that the house has been burglarized according to the information collected by the magnetism sensor, the central controller 101 outputs the second warning signal to control the alarm unit 107 to output a second audible alarm signal with 70 dBA of volume and controls the full-color LED 106 to turn yellow.

The central controller 101 sends the processed information to the WiFi unit 1022, then the WiFi unit 1022 transmits the processed information to the external wireless router 200 matched with the WiFi unit 1022. Thus, the external wireless router 200 uploads the processed information to a terminal device in the possession of user, so that at all times, wherever the user may be, he can keep track of the changes to house.

In at least one embodiment, the terminal device can be a mobile phone, a pad, or other electric device. In at least one embodiment, the WiFi unit 1022 can be used separately or simultaneously as a WiFi repeater to enhance the network signal, and expand network coverage.

In at least embodiment, the central controller 101 is further configured to setup control commands to the at least one sensor (301~30*n*) through the low power consumption communication unit 1021 to control the information acquisition times and information sending periods of the at least one sensor.

In at least one embodiment, the data interface 103 is electrically connected to the central controller 101. The data interface 103 is configured to charge an external electronic device, and further configured to access a mobile network adapter to connect to a network in the event of the external wireless router 200 failure, so that the processed information can be uploaded to the terminal device in time. In at least one embodiment, the data interface can be a Universal Serial Bus interface.

In at least one embodiment, the intelligent household controller 100 further comprises a button 105. The button 105 is electrically connected to the central controller 101. The central controller 101 is further configured to switch the central controller 101 between different operation modes by the button 105 being pressed.

When the central controller 101 detects one press on the button 105, the central controller operates in night-light mode to drive the full-color LED 106. The full-color LED can be operated in a non-illumination mode or a illumination mode. The full-color LED 106 operates in the illumination mode in accordance with one press on the button 105 detected by the central controller 101, when the full-color LED 106 is in non-illumination mode. The full-color LED 106 operates in the non-illumination mode in accordance with one press on the button 105 detected by the central controller 101, when the full-color LED 106 is in illumination mode. In at least one embodiment, the brightness and color of the full-color LED 106 in the night-light mode are adjusted by a program of the terminal device of the user.

When the central controller 101 detects two presses on the button 105, the central controller 101 operates in one touch configuration mode. The WiFi unit 1022 searches the external wireless router 200 to automatically initiate a connection with the external wireless router 200.

When the central controller 101 detects a press on the button 105 persisting for a first predetermined time period, the central controller 101 operates in a WiFi protected setup mode. The WiFi unit 1022 initiates a rapid connection with the external wireless router 200. In this disclosure, the central controller 101 being able to operate in the WiFi protected setup mode requires that the external wireless router 200 has the function of WiFi protected setup. The first predetermined time is set to be 2 seconds.

When the central controller detects the press on the button 105 persisting for a second predetermined time period, the central controller operates in one-touch reset mode, to revert to default settings. In this disclosure, the second predetermined time is set to 5 seconds. It takes about 50-90 milliseconds to implement a press on the button 105. It takes about 500 milliseconds for the eyes to recognize that full-color lighting of the LED 106 is activated.

In at least one embodiment, the power supply unit 104 is electrically connected to the central controller 101. The power supply unit 104 distributes the power supply to every component through the central controller 101. In this disclosure, the AC voltage of the power supply unit 104 is 100-240V, the frequency is 50 or 60 Hz, the current is 0.3 A, the DC voltage output is 5V, and the maximum output current is 1.7 A.

Many details are often found in the art such as the other features of intelligent household controller. Therefore, many such details are neither shown nor described. Even though numerous characteristics and advantages of the present technology have been set forth in the foregoing description, together with details of the structure and function of the present disclosure, the disclosure is illustrative only, and changes may be made in the detail, especially in matters of shape, size, and arrangement of the parts within the principles of the present disclosure, up to and including the full extent established by the broad general meaning of the terms used in the claims. It will therefore be appreciated that the embodiments described above may be modified within the scope of the claims.

What is claimed is:

1. An intelligent household controller configured to receive information collected by at least one sensor, comprising:

a communication unit configured to receive the information collected by at least one sensor, and further configured to send control commands to the at least one sensor;

a central controller coupled to the communication unit is configured to process the information received by the communication unit and outputting processed information to the communication unit, wherein the central controller is further configured to output the control commands to the communication unit;

an alarm unit coupled to the central controller is configured to output audible alarm signals; and a button coupled to the central controller is configured to switch operation modes of the central controller; wherein when the central controller detects one press on the button, the central controller is configured to operate in a night-light mode;

when the central controller detects two presses on the button, the central controller is configured to operate in a one touch configuration mode;

when the central controller detects a press on the button persisting for a first predetermined time period, the central controller operates in a WiFi protected setup mode; and when the central controller detects a press on the button persisting for a second predetermined time period, the central controller operates in a one-touch reset mode.

2. The intelligent household controller of claim 1, wherein the communication unit is further configured to send the processed information to an external wireless router.

3. The intelligent household controller of claim 2, wherein the communication unit comprises:

a first communication unit coupled to the central controller is configured to receive the information collected by the at least one sensor, and sending the control commands to the at least one sensor; and a WiFi unit coupled to the central controller and matched with the external wireless router for sending the processed information to the external wireless router.

4. The intelligent household controller of claim 1, wherein the central controller is further configured to output different warning signals, in accordance with the processed information, and to control the alarm unit outputting the audible alarm signals with different properties.

5. The intelligent household controller of claim 4, further comprising a color LED unit coupled to the central controller for emitting different colors in accordance with the different warning signals outputted by the central controller.

6. The intelligent household controller of claim 1, wherein the control commands comprise information collection time command and information sending period command of the at least sensor.

7. The intelligent household controller of claim 1, further comprising a data interface for charging an external electronic device and accessing a mobile network adapter.

8. The intelligent household controller of claim 1, further comprising a power supply unit coupled to the central controller.

9. The intelligent household controller of claim 1, wherein the at least one sensor is a combination of one or more of sensors.

* * * * *